US005372153A

United States Patent [19]

Dobson

[11] Patent Number: 5,372,153

[45] Date of Patent: Dec. 13, 1994

[54] PALLET CLEANER

[75] Inventor: Joseph R. Dobson, Sterling Heights, Mich.

[73] Assignee: Precision Dispense, Inc., Sterling Heights, Mich.

[21] Appl. No.: 31,667

[22] Filed: Mar. 15, 1993

[51] Int. Cl.[5] ..... B08B 3/02

[52] U.S. Cl. ..... 134/107; 134/83; 134/153; 134/165

[58] Field of Search ..... 134/105, 107, 125, 131, 134/151, 153, 165, 72, 66, 83, 144

[56] References Cited

U.S. PATENT DOCUMENTS

| | | | |
|---|---|---|---|
| 880,713 | 3/1908 | Blair | 134/131 X |
| 2,592,857 | 4/1952 | Chadwick | 134/153 X |
| 2,714,892 | 8/1955 | Mendenhall | 134/72 |
| 3,179,117 | 4/1965 | Gibson et al. | 134/131 X |
| 3,217,348 | 11/1965 | Simmons | 15/93 |
| 3,849,820 | 11/1974 | Lang | 15/21 C |
| 4,281,675 | 8/1981 | Pure | 134/125 |
| 4,739,780 | 4/1988 | Czaja et al. | 134/131 X |

FOREIGN PATENT DOCUMENTS

| | | | |
|---|---|---|---|
| 238099 | 11/1960 | Australia | 134/72 |
| 612453 | 11/1948 | United Kingdom | 134/151 |

*Primary Examiner*—Philip H. Coe
*Attorney, Agent, or Firm*—Krass & Young

[57] ABSTRACT

A pallet cleaner especially suitable for use in cleaning plastic pallets. The cleaner includes a vertically oriented horizontally extending chamber having a vertically oriented entry opening at one end of the chamber and a vertically oriented exit opening at the other end of the chamber. The pallets are loaded on edge into the chamber through the vertically oriented entry opening, moved through the chamber on edge while a heated pressurized fluid is directed against the upper and lower sides of the pallet, and thereafter are moved on edge out of the chamber through the exit opening. The cleaner further includes wheels so that the cleaner is portable and may be rolled to the site of pallets to be cleaned rather than requiring the pallets to be cleaned to be brought to the site of the cleaner.

18 Claims, 5 Drawing Sheets

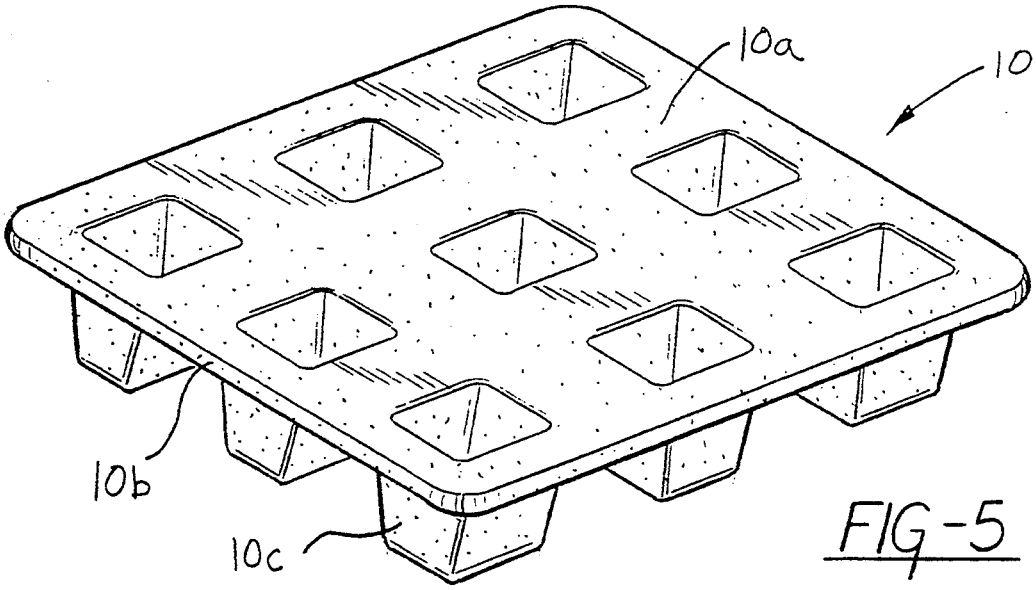
FIG-5
FIG-6
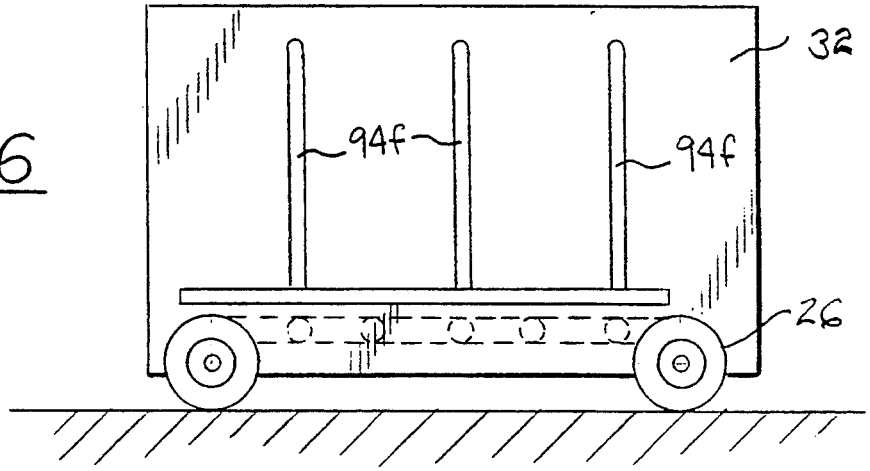
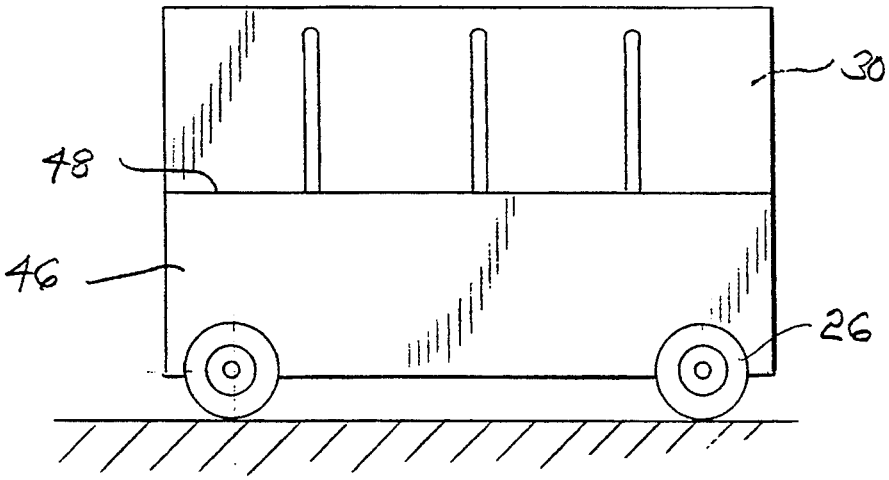
FIG-7

PALLET CLEANER

BACKGROUND OF THE INVENTION

This invention relates to pallet cleaners and more particularly to a cleaner especially adapted to clean plastic pallets.

Pallets have traditionally been formed of wood. Wood pallets, however, have many disadvantages. For example, they are subject to breakage and thus are not reusable over an extended period of time. Wood pallets also take up a considerable amount of valuable floor space in tile warehouse when they are not in use. Wood pallets are also very difficult to clean and therefore are not suitable for use in hygienically sensitive environments such as in association with foods. In an effort to solve some of the problems associated with wood pallets, plastic pallets have been employed with a considerable degree of success. Whereas plastic pallets are more durable and are therefore reusable over an extended period of time, they tend to become unsanitary with extended usage and, especially in situations where the pallets are utilized in a hygienically sensitive environment, the pallets must be cleaned on a regular basis. Various devices have been proposed for cleaning pallets, but these prior art pallet cleaners are extremely complicated and expensive and in, general, comprise fixed installation so that the pallets to be cleaned must be brought to the cleaner.

SUMMARY OF THE INVENTION

This invention is directed to the provision of an improved pallet cleaner.

More specifically, this invention is directed to the provision of a pallet cleaner that is simple and inexpensive.

This invention is further directed to the provision of a pallet cleaner that is portable so that the cleaner may be moved to the site of pallets to be cleaned.

The invention cleaner is for use in cleaning pallets of the type including a planar platform section bounded by a peripheral edge. The invention cleaner includes a cleaner housing defining a vertically oriented chamber sized to accommodate a pallet placed on edge and including an entry opening sized to pass a pallet placed on edge so that the pallet may move on edge into the chamber and an exit opening sized to pass a pallet placed on edge so that the pallet may move on edge out of the chamber; horizontal conveyor means positioned within the housing proximate the lower end of the chamber extending from the entry opening of the chamber to the exit opening of the chamber and operative to receive a pallet moved on edge through the entry opening and convey the pallet on edge through the chamber along a cleaning path for discharge on edge through the exit opening; and means for delivering pressurized fluid against the upper and lower sides of the platform section of the on edge pallet as the pallet moves through the chamber on the conveyor means. This arrangement provides a simple and effective means of cleaning pallets and is especially suitable for use in cleaning plastic pallets.

According to a further feature of the invention, the pressurized fluid comprises a heated pressurized fluid, whereby to further increase the effectiveness of the cleansing operation.

According to a further feature of the invention, the cleaner further includes laterally spaced longitudinally extending guide rails positioned within the chamber above the conveyor means and sized to pass the platform section of the pallet therebetween. This guide structure ensures that the pallets will pass through the chamber along a predetermined cleaning path.

According to a further feature of the invention, the device further includes wheels rollably supporting the housing so that the cleaner is portable and may be rolled to the site of pallets to be cleaned rather than requiring that the pallets to be cleaned be brought to the site of the cleaner.

According to a further feature of the invention, the fluid delivery means includes a plurality of nozzles positioned in the chamber on opposite sides of the cleaning path and means for delivering heated pressurized fluid to the nozzles. The delivery of heated pressurized fluid through nozzles against opposite sides of the platform section of the pallet ensures that the pallet is thoroughly cleaned during its passage through the chamber.

According to a further feature of the invention, the means for delivering heated pressurized fluid to the nozzles comprises a tank, a heater associated with the tank, conduits extending from the tank to the nozzles, and a pump for pumping fluid under pressure from the tank through the conduits to the nozzles.

According to a further feature of the invention, the tank, heater, and pump are positioned laterally of the housing and the conduits extend laterally from the pump to the nozzles. In the disclosed embodiment of the invention, the cleaner further includes an equipment housing positioned laterally of the cleaner housing and rigid with the cleaner housing and the tank, heater, and pump are positioned in the equipment housing.

According to a further feature of the invention, the cleaner further includes power means operative to drive the conveyor means and the power means is positioned laterally of the cleaner housing and includes a drive shaft extending laterally into the cleaner housing. In the disclosed embodiment of the invention, the power means is positioned in the equipment housing.

The invention also provides a methodology for cleaning pallets comprising the steps of providing a vertically oriented horizontally extending chamber having a vertically oriented entry opening at one end of the chamber and a vertically oriented exit opening at the other end of the chamber; loading the pallets on edge into the chamber through the vertically oriented entry opening; moving the pallets through the chamber on edge while a pressurized fluid is directed against the upper and lower sides of the platform section of the pallet; and thereafter moving the pallets on edge out of the chamber through the exit opening.

According to a further feature of the invention methodology, the chamber is defined by a housing and the method includes the further step of providing wheels rollably supporting the housing so that the cleaner is portable and may be rolled to the site of pallets to be cleaned.

BRIEF DESCRIPTION OF THE DRAWING

FIG. 5 is a perspective view of a plastic pallet suitable for cleaning by the invention pallet cleaner;

FIG. 6 is a side view of one side of the invention pallet cleaner;

FIG. 7 is a side view of the other side of the invention pallet cleaner;

DETAILED DESCRIPTION OF THE PREFERRED EMBODIMENT

Figure 1:
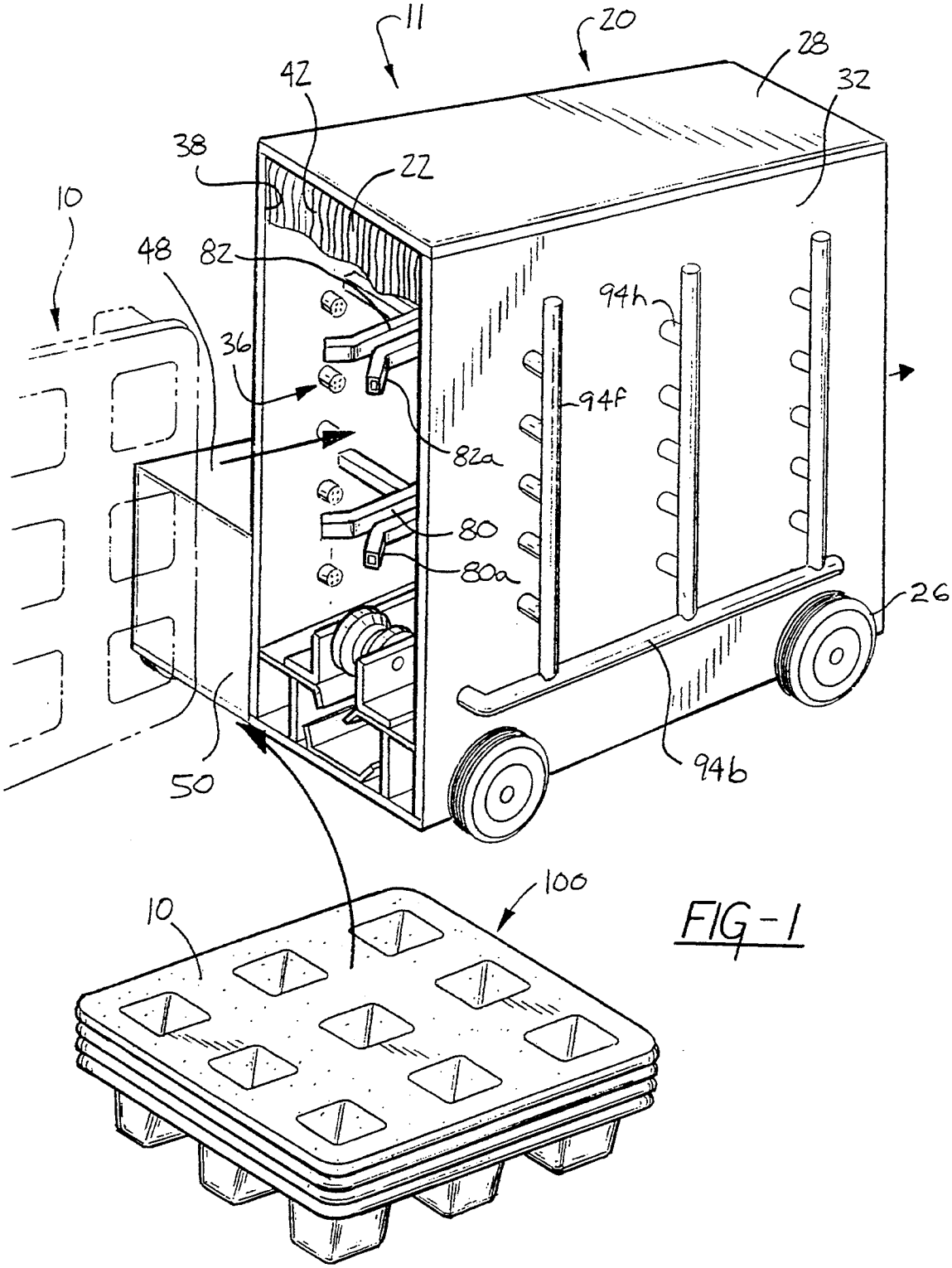
FIG. 1 is a perspective view of a pallet cleaner according to the invention.
Figure 3:
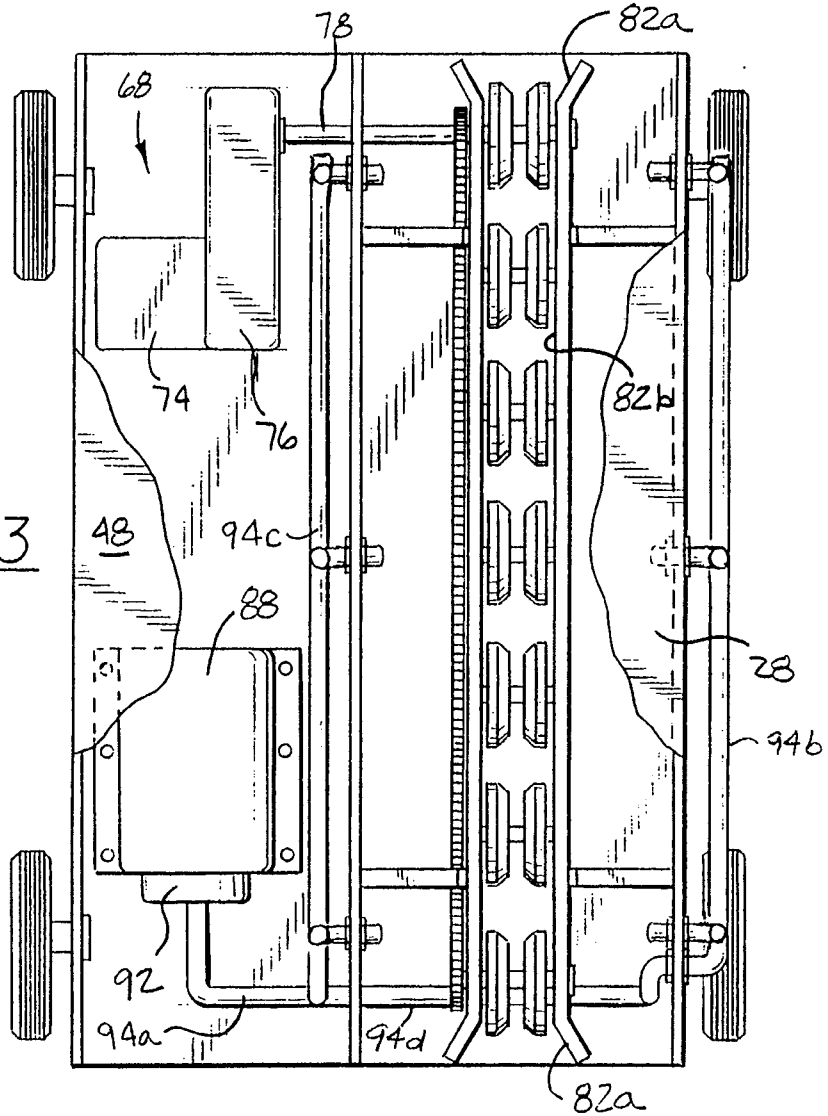
FIG. 3 is a top view of the invention pallet cleaner.
Figure 2:
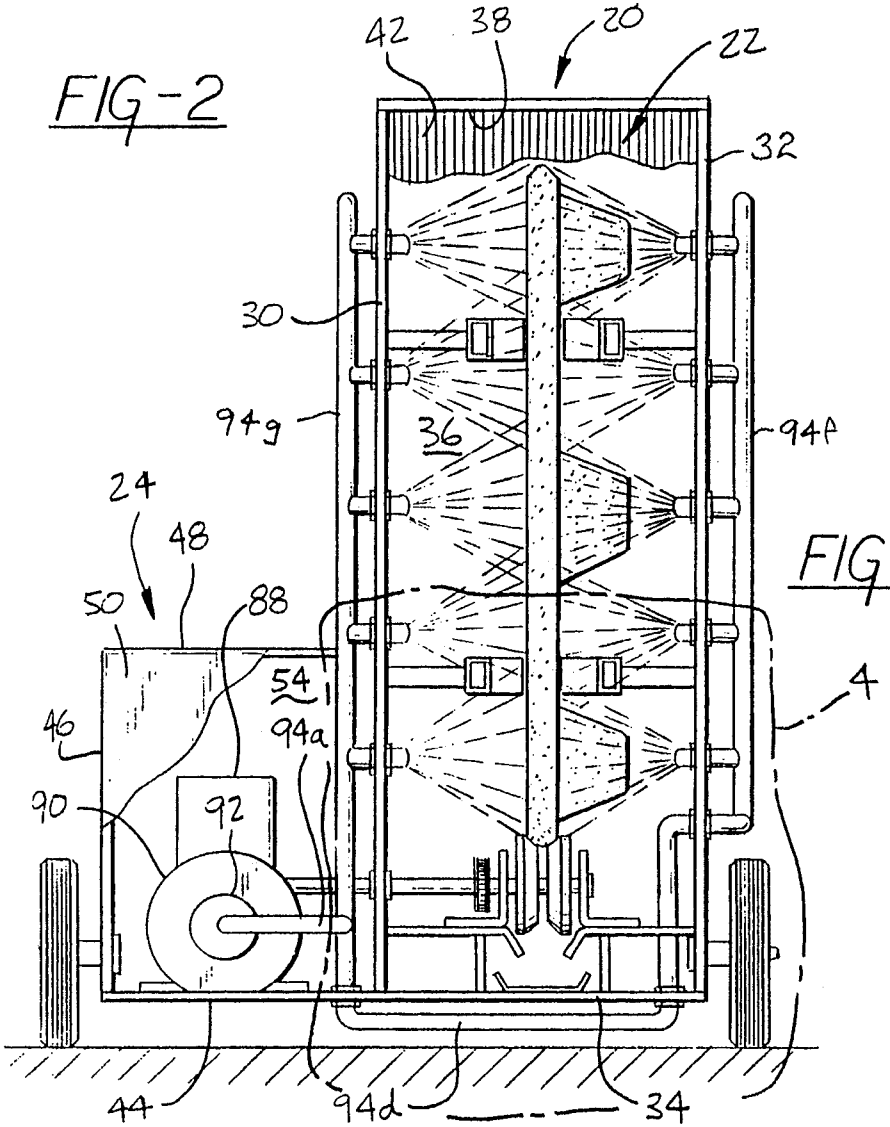
FIG. 2 is a front end view of the invention pallet cleaner.
Figure 4:
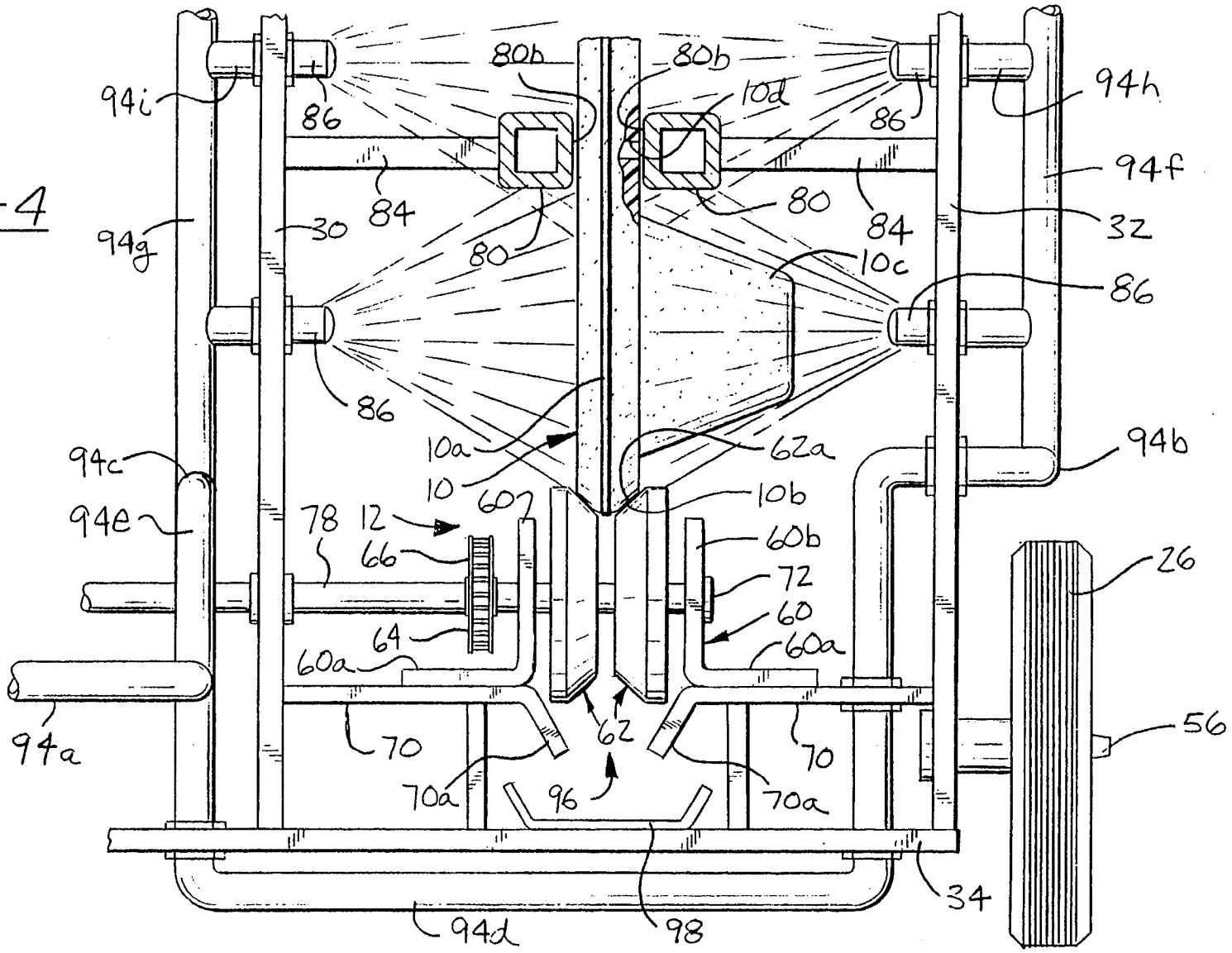
FIG. 4 is a detail view of the invention pallet cleaner taken within the circle 4 of FIG. 2.
Figure 8:
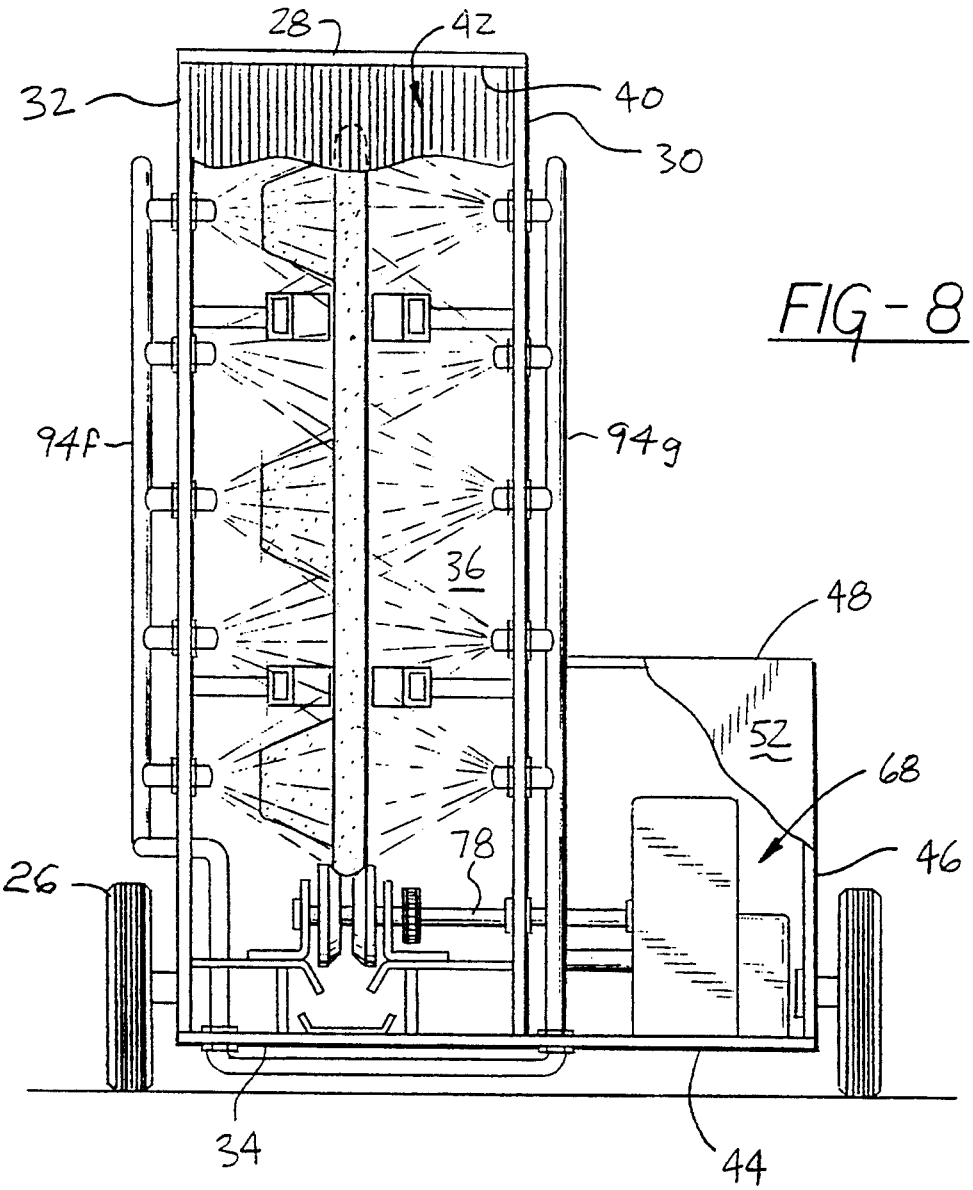
FIG. 8 is a rear end of the invention pallet cleaner.

The invention pallet cleaner is especially suitable for use in cleaning plastic pallets 10 of the type shown, for example, in FIG. 5. Pallet 10 includes a generally rectangular planar platform section 10*a* adapted to support a load and bounded by a peripheral edge 10*b* having a general V-shaped cross section. Pallet 10 may also include a plurality of downwardly extending upwardly opening legs 10*c* which support the platform section 10*a* in an elevated position over a support surface and which are hollow so as to allow the pallets to be stacked for storage purposes when not in use.

The invention pallet cleaner, broadly considered, includes a housing assembly 11, a conveyor assembly 12, a guide rail assembly 14, a fluid delivery assembly 16, and a waste removal assembly 18.

Housing assembly 11 includes a main or cleaner housing 20, curtains 22, an auxiliary housing 24, and wheels 26.

Main or cleaner housing 20 is preferably formed of stainless steel panels and includes a top wall 28, side walls 30 and 32, and a bottom wall 34. Housing 11 will be seen to have a rectangular prismatic configuration and to define a vertically oriented chamber 36 sized to generally accommodate a pallet 10 placed on edge. The housing will be seen to further define a vertically oriented generally rectangular entry opening 38 sized to pass a pallet placed on edge, so that the pallet may move on edge into the chamber 36, and an exit opening 40 sized to pass a pallet placed on edge so that the pallet may move on edge out of the chamber 36. Walls 28, 30, 32, and 34 are secured together by any suitable means and may be detachably secured together to facilitate repair or maintenance of the cleaner.

Figure 9:
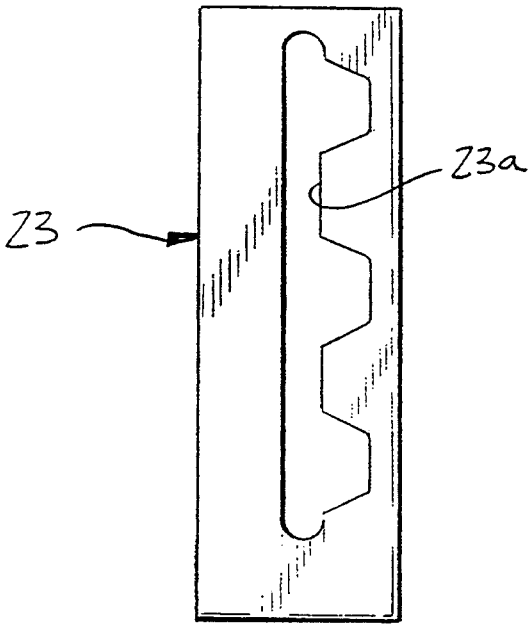
FIG. 9 is a view of a template for use with the invention pallet cleaner.

Curtains 22 are positioned in entry and exit openings 38 and 40. Each curtain includes a plurality plastic strips 42 fixedly secured at their upper ends to top wall 28 and hanging in a respective opening 38,40 in side-by-side relation so as to form a barrier closing the respective opening but so as to allow the entry of a pallet through the entry opening 38 and the exit of a pallet through the exit opening 40 by a parting of the strips Although the strips 42 are shown for purposes of clarity in the drawings as extending only part way down the respective openings 38 and 40, it will be understood that the strips hang the entire length of the respective openings so as to provide a barrier covering the entire respective opening. Alternatively (FIG. 9) the curtains may be replaced by rigid template plates 23 positioned in the respective opening 38, 40 and having a cut-out 23*a* simulating the cross-sectional configuration of an on-edge pallet 10 so that a pallet may be passed on-edge through the template cut-out of the entry template for entry into chamber 36 and a pallet may be passed on edge through the template cut-out of the exit template for discharge from chamber 36.

Auxiliary housing 24 also has a rectangular prismatic configuration and is also preferably formed of stainless steel panels. Auxiliary housing 24 is positioned laterally of main housing 20 and is longitudinally coextensive with main housing 20. Auxiliary housing 24 includes a lower wall 44 formed as a lateral extension of the lower wall 34 of the main housing, an outboard side wall 46, a top wall 48 suitably secured to main housing side wall 30, a front end wall 50, and a rear end wall 52.

Auxiliary housing 24 will be seen to define an auxiliary chamber 54 positioned laterally of chamber 36 and longitudinally coextensive with chamber 36.

Wheels 26 are provided at each corner of the housing assembly 11 with each wheel suitably secured to the respective housing side wall as by an axle 56. Alternatively, one or more wheels 26 may comprise castor wheels mounted to the housing assembly in a swivelling manner so as to facilitate the maneuvering of the cleaner in confined spaces.

Conveyor assembly 12 includes a pair of angle irons 60, a plurality of conveyor rollers 62, a plurality of sprockets 64, a chain 66, and power means 68.

Each angle iron 60 is positioned on a raised floor panel 70 of the main housing 20 and extends substantially the full length of chamber 36. Each angle iron includes a horizontal leg portion 60*a* secured to the respective floor panel 70 and an upstanding leg portion 60*b*. The upstanding leg portions 60*b* of the angle irons are laterally spaced by a distance to accommodate a pair of rollers 62.

Rollers 62 are arranged in pairs at longitudinally spaced locations along and between the angle irons with each pair of rollers mounted fixedly on an axle 72 passing through the pair of rollers and journalled in the upstanding leg portions 60*b* of the angle irons. Each roller 62 includes a bevelled inboard face 62*a* and the bevelled inboard faces 62*a* of each pair of rollers coact to define a V-shaped groove for receipt of the V-shaped peripheral edge portion 10*b* of a pallet.

A sprocket 64 is fixedly secured to one end of each axle 72 and a chain 66 is trained about all of the sprockets 64 so that rotational movement of one sprocket 64 is imparted to all of the sprockets 64, and thereby to all of tile rollers 62, upon movement of the chain 66.

Power means 68 is positioned in chamber 54 of auxiliary housing 24 proximate the rear end of the auxiliary housing and includes an electric motor 74 driving a gear reduction unit 76. Gear reduction unit 76 in turn has an output shaft 78 which passes laterally through the side wall 30 of main housing 20 and forms a lateral extension of the axle 72 mounting the rearmost pair of rollers 62 so that actuation of motor 74 drives gear reduction unit output shaft 78 which in turn drives the rearmost sprocket 64 and thereby rotates all of the pairs of rollers 62 via the chain 66 so that a pallet 10 with its peripheral edge 10*b* positioned in the V-shaped groove defined between the pairs of rollers 62 will be conveyed through the chamber 36.

Guide rail assembly 14 includes a pair of laterally spaced lower guide rails 80 and a pair of laterally spaced upper guide rails 82. Each pair of guide rails 80,82 is laterally spaced by an amount to accommodate the thickness of the platform section 10*a* of the pallet and extends the full length of the chamber 36. The ends 80*a*,82*a* of the rails are flared outwardly proximate the entry opening of the chamber and proximate the exit opening of the chamber to facilitate on edge insertion of a pallet into the cleaner and on edge removal of a pallet from the cleaner. As shown, rails 80,82 may have a rectangular tubular configuration so as to provide flat inboard faces **80*b*,82*b* for guiding, sliding coaction with the upper and lower sides of the platform section 10*a* of a pallet. Each rail 80,82 is positioned proximate the path of the pallet as the pallet moves through the chamber by a strut 84 suitably secured to the respective side wall of the main housing and extending laterally from the side wall for connection at its inboard end to the respective rail 80,82**.

Fluid delivery assembly 16 includes a plurality of nozzles 86, a heater 88, a tank 90, a pump 92, and a conduit or pipe network 94.

Nozzles 86 are positioned on the respective inboard faces of main housing side walls 30 and 32 in vertically and longitudinally spaced relation and are arranged to coact so as to, in combination, spray the entire upper and lower sides of the platform section of a pallet 10 moving on edge through the chamber 36.

Specifically, 15 nozzles may be provided on each side wall 30,32 with the nozzles on each side wall arranged in three vertical rows of five each.

Heater 88, tank 90, and pump 92 are positioned in chamber 54 of auxiliary housing 24 proximate the forward end of the chamber and are arranged to deliver a supply of heated pressurized fluid to conduit network 94 for delivery to nozzles 86. The heater, tank, and pump assembly may take various forms but, in each case, may comprise a tank for receiving a fluid to be heated, a heater for heating the fluid, and a pump for delivering the heated fluid under pressure through the conduit network to the nozzles. The heater, tank, and pump assembly may be arranged to deliver fluid to the nozzles either in liquid or gaseous (steam) form depending on the specifications of a given cleaning operation. For example, a system for delivering heated and pressurized hot water through the conduit network to the nozzles is available from Alkota Cleaning Systems, Inc. of Alcester, S.D. as Part No. 2128.

Conduit network 94 includes a conduit **94*a* receiving the output of pump 92; a manifold 94*b* positioned outboard of main housing side wall 32; a manifold 94*c* positioned outboard of main body housing wall 30; conduit means 94*d* interconnecting conduit 94*a* and manifold 94*b*; conduit means 94*e* interconnecting conduit 94*a* and manifold 94*c*; a plurality of standpipes 94*f* positioned in longitudinally spaced relation outboard of main housing side wall 32 and connected at their respective lower ends to manifold 94*b*; a plurality of standpipes 94*g* positioned outboard of the side wall 30 of main housing 20 in longitudinally spaced relation and connected at their respective lower ends of manifold 94*c*; a plurality of connector conduits 94*h* extending from the respective standpipe 94*f* and through housing side wall 32 for connection with a respective nozzle 86; and a plurality of connector conduits 94*i* extending from a respective standpipe 94*g* and through housing side wall 30 for connection to a respective nozzle 86**.

Waste removal assembly 18 comprises a trough 96 formed by the down turned inboard ends **70*a* of housing floor panels 70 and a tray 98 slidably and removably positioned on the upper face of housing bottom wall 34 in underlying relation to trough 96 so that residue and debris passing downwardly through trough 96 as a result of a pallet cleaning operation is collected in the tray 98**.

It will be understood that, in a situation where a heated liquid is delivered to the nozzles 86 rather than a heated gas, provision would also be made to drain the liquid from the housing and further provision would desirably be made to reclaim the liquid for redelivery to the tank 90 for reuse in a subsequent wash cycle. Further, in a situation where a heated liquid is delivered to the nozzles, rails 80 may be positioned such that the inboard faces **80*b*, 82*b* of the rails, in addition to guiding the platform section of the pallet as the pallet moves through the chamber, also serve to cover any holes (such as holes 10*d***) left in the pallet during the fabrication of the pallet so as to preclude the entry of water into the hollow interior of the pallet.

In the use of the invention pallet cleaner, the pallet is moved on its wheels 26 to a site where pallets to be cleaned have been stacked for storage and subsequent cleaning. A stack of plastic pallets to be cleaned is seen at 100 in FIG. 1. Specifically, the pallet cleaner is moved to a position in which the entry end 38 of the cleaner is positioned proximate the stack 100 of pallets to be cleaned, whereafter a single operator may lift the pallets one by one from the stack, place each pallet on edge, and then pass the pallet on edge through the entry opening 38 and through curtain 22 to position the lower peripheral edge **10*b* of the pallet in the V-shaped groove defined between the roller pairs 62 while ensuring that the platform section 10*a* of the pallet is positioned between upper and lower pairs of guide rails 80,82**.

The invention pallet cleaner may be operated on a continuous basis or on an individual or batch basis. In either event, as the pallet is positioned within the chamber of the main housing with its peripheral edge **10*b* positioned in the V-shaped groove defined by the rollers 62, the rollers are actuated by the power means 68 to move the pallet through the chamber 36 and the fluid delivery assembly 16 is actuated to deliver heated pressurized fluid to the nozzles 86 so that a stream of pressurized fluid is directed against the upper and lower sides of the platform section 10*a* of the pallet as the pallet moves on edge through the chamber. Following the movement of the pallet through the chamber, the pallet leaves the chamber on edge by passage through the exit opening 40 and through curtain 22, whereupon the same operator who has inserted the pallet into the entry opening 38** may remove the pallet and place it on an appropriate stack of clean pallets ready for future use.

As residue and debris is removed from the pallet, the residue moves downwardly through the trough 96 for collection in the pan 98 which may be periodically removed to clean the pan and replace it for use in cleaning further pallets. The spray nozzles 86 are distributed in such a way, and have a spray pattern such that, the nozzles in combination spray the entire upper and lower surfaces of the pallet as the pallet is moved through the chamber 36. Once the pallets 10 in the stack 100 have been cleaned by passage on edge through the pallet cleaner, the pallet cleaner may be rolled by any suitable means (such for example as being towed by a hilo) to another pallet location where another stack of dirty pallets may be cleaned.

It will be understood that, at each location, the electric motor 74, the heater 88, and pump 92 are connected to a suitable source of electric power, and the tank 90 is connected to a suitable source of water. Following each use of the pallet cleaner at a given location, the electrical and water connections are disconnected and the pallet is moved to a new location where the electrical and water connections are reestablished to perform a further cleaning operation with respect to a further stack of dirty pallets.

The invention will be seen to provide a simple and inexpensive means of effectively cleaning pallets, especially pallets formed of a plastic material. The invention pallet cleaner is simple in construction, inexpensive to manufacture, requires little maintenance, and is totally portable so that the cleaner may be rolled to the location of pallets to be cleaned rather than requiring the pallets to be brought to a fixed site of the cleaner.

Whereas a preferred embodiment of the invention has been illustrated and described in detail, it will be apparent that various changes may be made in the disclosed embodiment without departing from the scope or spirit of the invention.

I claim:

1. A cleaner for use in cleaning pallets of the type including a planar platform section bounded by a peripheral edge, said cleaner comprising:

a cleaner housing defining a vertically oriented chamber sized to accommodate a pallet placed on edge and including an entry opening sized to pass a pallet placed on edge, so that the pallet may move on edge into the chamber, and an exit opening sized to pass a pallet placed on edge, so that the pallet may move on edge out of the chamber;

horizontal conveyor means positioned within the housing proximate the lower end of the chamber extending from the entry opening of the chamber to the exit opening of the chamber and operative to receive a pallet moved on edge through the entry opening and convey the pallet on edge through the chamber along a cleaning path for discharge on edge through the exit opening, said conveyor means comprising a plurality of pairs of powered rollers, the rollers being supported for rotation about horizontally aligned axes, the pairs of rollers being spaced longitudinally between the entry opening and the exit opening, the rollers in each pair being spaced to receive the lower peripheral edge of a pallet to engage such edge and move the pallet between the entry opening and the exit opening; and means for delivering pressurized fluid against the upper and lower sides of the platform section of the on edge pallet as the pallet moves through the chamber on the conveyor means.

2. A cleaner according to claim 1 wherein the fluid comprises a heated pressurized fluid.

3. A cleaner according to claim 2 wherein:

the fluid delivery means includes a plurality of nozzles positioned in said chamber on opposite sides of the cleaning path and means for delivering heated pressurized fluid to the nozzles.

4. A cleaner according to claim 3 wherein:

the means for delivering heated pressurized fluid to the nozzles comprises a tank, a heater associated with the tank, conduits extending from the tank to the nozzles, and a pump for pumping fluid under pressure from the tank through the conduits to the nozzles.

5. A cleaner according to claim 4 wherein:

the tank, heater, and pump are positioned laterally of the housing and the conduits extend laterally from the pump to the nozzles.

6. A cleaner according to claim 5 wherein:

the cleaner further includes an equipment housing positioned laterally of the cleaner housing and rigid with the cleaner housing; and the tank, heater, and pump are positioned in the equipment housing.

7. A cleaner according to claim 6 wherein:

the cleaner further includes wheels rollably supporting the cleaner housing and the equipment housing so that the cleaner is portable and may be rolled to the site of pallets to be cleaned.

8. A cleaner according to claim 1 wherein the cleaner further includes:

laterally spaced longitudinally extending guide rails positioned within the chamber above the conveyor means and sized to pass the platform section of the pallet therebetween.

9. A cleaner according to claim 1 wherein:

the device further includes wheels rollably supporting the housing so that the cleaner is portable and may be rolled to the site of pallets to be cleaned.

10. A cleaner according to claim 1 wherein:

the cleaner further includes power means operative to drive the conveyor means; and the power means is positioned laterally of the cleaner housing and includes a drive shaft extending laterally into the cleaner housing.

11. A cleaner according to claim 10 wherein:

the cleaner further includes an equipment housing positioned laterally of the cleaner housing and rigid with the cleaner housing; and the power means is positioned in the equipment housing.

12. A cleaner for pallets of the type including a planar platform section bounded by a peripheral edge, characterized in that:

the cleaner includes a housing defining a vertically oriented horizontally extending chamber having a vertically oriented entry opening at one end of the chamber and a vertically oriented exit opening at the other end of the chamber;

a longitudinally aligned series of pairs of powered rollers within the housing wherein the pallets are loaded on edge into the chamber through the vertically oriented entry opening so that their lower edges engage the longitudinally aligned series of pairs of powered rollers, are moved through the chamber on edge, and thereafter are moved on edge out of the chamber through the exit opening by said rollers; and the cleaner further includes means for directing a pressurized fluid against the upper and lower sides of the platform section of the on edge pallet as the pallet is moved through the chamber.

13. A cleaner according to claim 12 wherein:

the cleaner further includes wheels rollably supporting the housing so that the cleaner is portable and may be rolled to the site of pallets to be cleaned.

14. A cleaner according to claim 12 wherein:

the pressurized fluid comprises a heated pressurized fluid.

15. A cleaner for pallets of the type including a planar platform section bounded by a peripheral edge, said cleaner comprising:

a main housing defining a vertically oriented horizontally extending chamber sized to accommodate a pallet placed on edge and including a vertically oriented entry opening at one end of the chamber sized to pass a pallet placed on edge and a vertically oriented exit opening at the other end of the chamber sized to pass a pallet placed on edge;

horizontally extending conveyor means positioned within the main housing proximate the lower end of the chamber, said conveyor means comprising a plurality of pairs of rollers, the rollers being supported for rotation about horizontally aligned axes, the pairs of rollers being spaced longitudinally between the entry opening and the exit opening, the rollers in each pair being spaced to receive the lower peripheral edge of a pallet to engage such edge and move the pallet between the entry opening and the exit opening;

an auxiliary housing positioned laterally of the main housing and rigid with the main housing;

a source of pressurized fluid positioned in the auxiliary chamber;

power means positioned in the auxiliary chamber and connected to the rollers to drive the rollers; and a plurality of nozzles positioned in the chamber, arranged to receive heated pressurized fluid from the source, and operative to direct a pressurized fluid against the upper and lower sides of the platform section of the pallet as the pallet is moved on edge through the chamber by the rollers.

16. A cleaner according to claim 15 wherein:

the cleaner further includes wheels rollably supporting the main housing and the auxiliary housing so that the cleaner is portable and may be rolled to the site of pallets to be cleaned.

17. A cleaner according to claim 15 wherein:

the pressurized fluid comprises a heated pressurized fluid.

18. A cleaner according to claim 15 wherein:

the cleaner further includes laterally spaced longitudinally extending guide rails positioned within the chamber above the conveyor means and sized to pass the platform section of the pallet therebetween.

* * * * *